US005480472A

United States Patent [19]

Noda et al.

[11] Patent Number: 5,480,472

[45] Date of Patent: Jan. 2, 1996

[54] METHOD FOR FORMING AN ELECTRICAL CONTACT MATERIAL

[75] Inventors: Yasushi Noda; Nobuyuki Yoshioka; Nobutaka Suzuki; Toshimasa Fukai, all of Shizuoka; Tetsuo Yoshihara; Koichi Koshiro, both of Osaka, all of Japan

[73] Assignee: Kabushiki Kaisha Meidensha, Tokyo, Japan

[21] Appl. No.: 738,189

[22] Filed: Jul. 30, 1991

[30] Foreign Application Priority Data

Aug. 2, 1990 [JP] Japan ..... 2-203887

[51] Int. Cl.[6] ..... B22F 3/00

[52] U.S. Cl. ..... 75/351; 75/352; 75/355; 75/369; 148/411; 148/432; 419/5; 420/495; 420/590; 428/546

[58] Field of Search ..... 148/411, 432; 420/495, 590; 75/351, 352, 355, 369'; 419/46, 66, 5; 428/546

[56] References Cited

U.S. PATENT DOCUMENTS 4,911,769 3/1990 Yamada et al. ..... 148/432

FOREIGN PATENT DOCUMENTS 3226604 1/1984 Germany .
209317 4/1984 Germany .
3729033 3/1988 Germany .
3810218 10/1988 Germany .
9015425 12/1990 WIPO .

*Primary Examiner*—David A. Simmons
*Assistant Examiner*—Robert R. Koehler
*Attorney, Agent, or Firm*—Bachman & LaPointe

[57] ABSTRACT

A method for forming an electrical contact material comprises the steps of melting a mixture of Cu and Cr into a molten alloy, atomizing the molten alloy into fine particles to obtain alloyed particles. Cr particles in the alloyed powder disintegrate to less than 5 μm in mean particle diameter. The alloyed powder is sintered thereafter and a mean particle diameter of chromium in the sintered article is fined in a range of 2 to 20 μm. An electrical contact material is composed of a copper matrix and chromium particles having a mean particle diameter of 2 to 20 μm. The chromium particles are homogeneously dispersed in the copper matrix.

7 Claims, 8 Drawing Sheets

METALLIC STRUCTURE OF Cu-10wt%Cr

METALLIC STRUCTURE OF Cu-20wt%Cr

METALLIC STRUCTURE
OF Cu-20wt%Cr

METHOD FOR FORMING AN ELECTRICAL CONTACT MATERIAL

BACKGROUND OF THE INVENTION

1. Field of the Invention

The present invention relates generally to an electrical contact material. Specifically, the present invention relates to an electrical contact material utilized in a variety of breakers and switches, where electric current varies intermittently.

2. Description of the Background Art

Generally, for electrical contact material for breakers or switches such as a vacuum interrupter, metals or alloys having characteristics of good electrical conductivity, low contact resistance, as well as being arc-proof and welding-proof are preferable. Conventionally, Cu—Cr alloys obtained by powder metallurgy techniques have been well known as such electric contact materials. Copper powder prepared by electrolytic methods, for example, and chromium powder prepared by milling are mixed then compacted under pressure. After compacting, the mixed powder is sintered to obtain desired Cu—Cr alloy. As a suitable electrical contact point, homogeneous distribution of Cr into a Cu matrix is necessary for obtaining the aforementioned characteristics. Further to say, the finer diameter of Cr particle, the better for the material.

However, particle distribution in materials of Cr prepared mechanically by milling methods becomes widely dispersed. Additionally, homogeneous fineness of Cr particle cannot be established easily. Therefore, weight variation occurs due to differing particle size, and such Cr particles cannot be homogeneously mixed with Cu powder. Therefore, Cr particles cannot be dispersed finely and homogeneously in the Cu matrix of a compacted article after sintering.

Classification of Cr particles using sieving means are effective for homogeneous distribution of fine particles, however, it causes severe degradation of yield and raises production cost.

Further milling of Cr particles using mechanical techniques is available to obtain fine particle size, but the surface of Cr particles is susceptible to the effects of oxygen in a course of mechanical processes. Therefore, oxidation of the Cr particle surfaces occurs in the process of milling and during storage, and the sinterability of the mixed powder becomes reduced.

Thus, the mean particle size of Cr compacted in an article prepared by conventional mechanical milling is limited in about 40 μm. Additionally, particle distribution of Cr cannot be accomplished uniformly.

Casting methods for forming Cu—Cr alloys also cannot be adopted, as the slow cooling speed of alloy solidification allows the size of Cr particles in the Cu matrix to be increased. Therefore, uniform distribution of fine Cr particles cannot be accomplished easily, further to say, segregation is apt to occur during solidification.

SUMMARY OF THE INVENTION

It is therefore a principal object of the present invention to provide an electrical contact material having good electrical conductivity, low contact resistance, arc-proof, and welding-proof characteristics.

It is another object of the present invention to provide an electrical contact material formed of Cu—Cr alloy, in which fine particles of Cr are uniformly dispersed in a Cu matrix.

It is a furthermore object of the present invention to provide a method for forming an electrical contact material of Cu—Cr alloy having fine particles of Cr uniformly distributed in a Cu matrix.

In order to accomplish the aforementioned and other objects, an electrical contact material is composed of a copper matrix, and chromium particles having a mean particle diameter of 2 to 20 μm. The chromium particles are homogeneously dispersed in the copper matrix.

The content of the chromium particles included in the copper matrix may be determined in the range of 5 to 20 wt %.

The electrical contact material can be formed of a sintered alloy powder having alloy elements of copper, chromium and inevitable impurities.

The content of the alloy element of chromium may be determined in the range of 0.1 to 37 wt %.

The alloy powder includes less than or equal to 5 μm of chromium homogeneously dispersed therethrough.

The alloy powder may be comprised of atomized particles having a mean particle diameter of less than or equal to 150 μm.

A method for forming an electrical contact material comprises the steps of melting a mixture of copper and chromium into a molten alloy, atomizing the molten alloy into fine particles to obtain an alloy powder, the atomizing step allowing a mean particle diameter of chromium to be less than or equal to 5 μm for homogeneous dispersion into a copper matrix, sintering the alloy powder, the chromium particles being fined after sintering in the range of 2 to 20 μm and being maintained in homogeneous dispersion in the copper matrix.

The melting step may be accomplished in atmosphere of inert gas. The inert gas can be selected from the group consisting of argon and nitrogen. Alternatively, the melting step is accomplished in a vacuum.

The atomizing may be accomplished by gas atomization. The gas may be inert gas selected from the group consisting of argon and nitrogen. Alternatively, the atomizing can be accomplished by water atomization.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENT

Figure 1A:
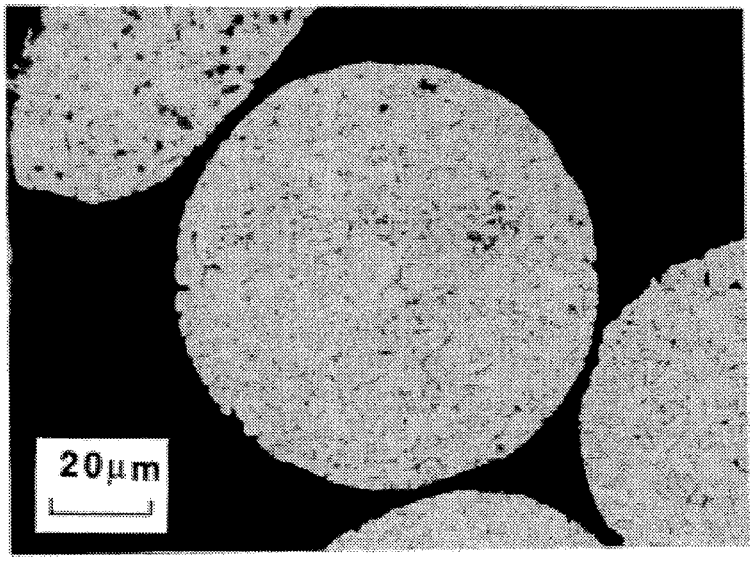
FIG. 1(*a*) and 1(*b*) are microphotographs showing metallic structure of Cu—Cr alloys of the present invention.

According to the aspect of the present invention, an atomization technique is utilized for disintegrating a mixture of alloy elements into fine alloyed powder in place of using a mechanical milling technique.

A mixture of Cu and Cr is melted to obtain a molten alloy. The obtained molten alloy is disintegrated into fine particles by atomization with rapidly solidifying. Cr content included in the mixture is determined so as to be dispersed in a Cu matrix at a boundary area and so that the Cu—Cr alloy is separated into a Cu phase and a Cr phase in the process of melting. From conventional phase diagram of Cu—Cr alloy, it is clear that if the Cr content exceed 37 wt %, the molten alloy is composed of a Cu matrix in is dispersed and a Cr matrix in which Cu is dispersed, particularly, if the Cr content exceeds 93 wt %, Cu dispersed in a Cr matrix. Therefore, the Cr content is determined less than or equal to 37 wt %, more preferable, determined in the range of 0.1 to 37 wt %. The mixture of Cu and Cr is prepared from Cu and Cr having low oxygen content therein to reduce oxygen content in the molten alloy. Furthermore, in order to further reduce oxygen content in the molten alloy, the mixture is deoxidized by melting in an atmosphere of inert gas, such as Ar, or melting in vacuum. Thus, oxygen content in the molten alloy is reduced less than 1000 ppm. Contamination by inevitable impurities, such as Fe or Ni, is allowable. For atomization of the molten alloy, gas atomization under high pressure using inert gas, such as Ar or $N_2$, or water atomization are suitable for disintegrating the molten alloy into fine particles.

EXAMPLE 1

Alloyed powder was prepared by the aforementioned gas atomization. A mixture of Cu and Cr was melted in an atmosphere of argon gas or in a vacuum to obtain a molten alloy. Then, the molten alloy was atomized using argon gas under the pressure of 60 kgf/cm$^2$ (5.89 MPa) or 70 kgf/cm$^2$ (6.87 MPa). Table 1 indicates the obtained alloyed powder having various components, when the Cr:Cu ratio, and melting conditions, i.e., atmosphere and temperature were varied.

TABLE 1

| | | Melting Condition | | Atomization | | |
|---|---|---|---|---|---|---|
| No. | Material | Atmosphere | Temp. (°C.) | Gas | Pressure (kgf/cm2) | Particle Size (μm) |
| 1 | Cu-0.5Cr | Argon | 1300 | Ar | 60 | <150 |
| 2 | Cu-5Cr | Argon | 1400 | Ar | 60 | <150 |
| 3 | Cu-10Cr | Argon | 1500 | Ar | 60 | <150 |
| 4 | Cu-10Cr | Vacuum | 1650 | Ar | 70 | <150 |
| 5 | Cu-15Cr | Argon | 1650 | Ar | 60 | <150 |
| 6 | Cu-20Cr | Argon | 1700 | Ar | 70 | <150 |
| 7 | Cu-20Cr | Vacuum | 1750 | Ar | 60 | <150 |
| 8 | Cu-25Cr | Argon | 1750 | Ar | 60 | <150 |
| 9 | Cu-30Cr | Argon | 1750 | Ar | 60 | <150 |

| | Composition of Powder | | | Mean Diameter of Cr |
|---|---|---|---|---|
| No. | Cu(wt %) | Cr(wt %) | O(ppm) | (μm) |
| 1 | 99.4 | 0.5 | 250 | 1.5 |
| 2 | 95.0 | 4.9 | 360 | 2.1 |
| 3 | 89.2 | 10.7 | 640 | 2.5 |
| 4 | 89.6 | 10.3 | 530 | 2.6 |
| 5 | 84.3 | 15.6 | 460 | 3.1 |
| 6 | 79.2 | 20.7 | 470 | 3.5 |
| 7 | 80.1 | 19.8 | 390 | 3.7 |
| 8 | 74.1 | 25.8 | 450 | 4.4 |
| 9 | 69.4 | 30.5 | 520 | 4.6 |

Figure 1B:
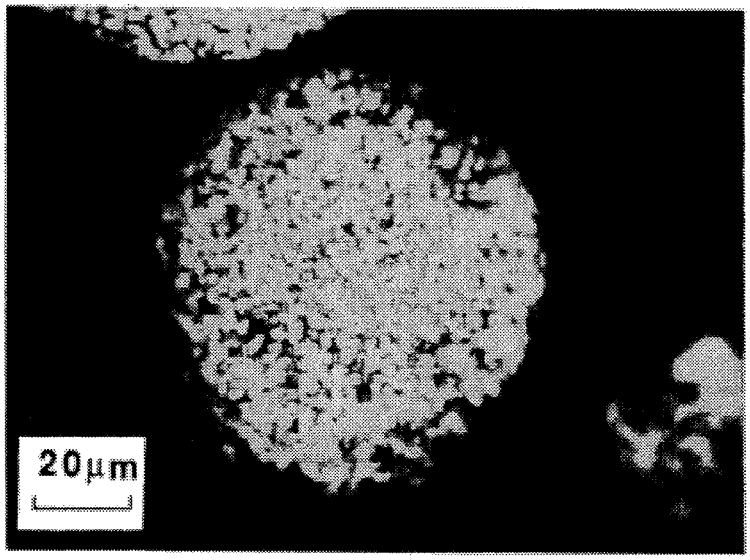

As shown in the Table 1, particle sizes of the obtained Cu—Cr powder are all less than 150 μm. Fine particles of Cr are distributed uniformly in the Cu matrix as shown in FIGS. 1(*a*) and 1(*b*). The mean particle sizes of Cr in the alloyed powder are all less than 5 μm. Initial Cu—Cr weight ratio of the mixture is maintained in the obtained alloyed powder. Oxygen content in the powder can be reduced less than 1000 ppm.

Figure 2:
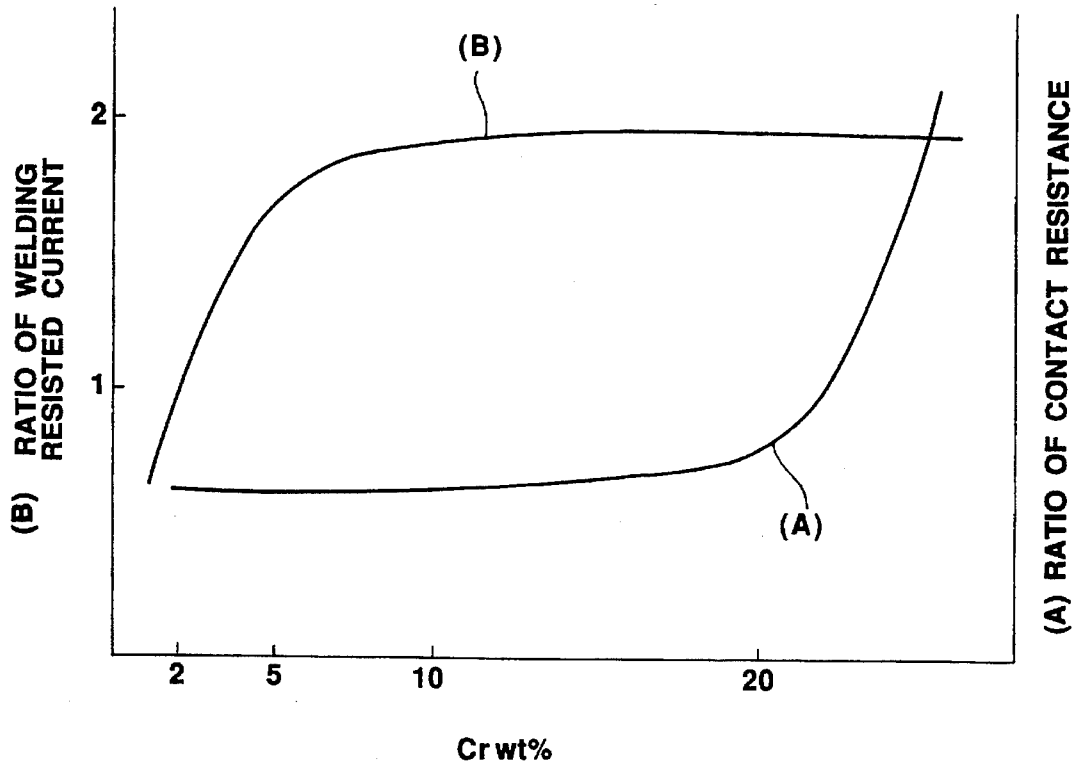
FIG. 2 is a graph showing relationships between Cr amount and both of contact resistance ratio and weld resist current.

The obtained alloyed powder was sintered to obtain an electrical contact material (the article, hereinafter) having desired characteristics. FIG. 2 shows relationships between Cr content and both of contact resistance ratio and welding resist current as compared to conventional articles. It is clear from FIG. 2, that an adaptable range of the Cr content of the article is limited in 5 to 20 wt %.

EXAMPLE 2

Cu-20 wt %Cr atomized powder, having a maximum particle size of less than 150 μm, with a mean Cr particle size of 3.5 μm, was put into a ceramic housing having a diameter of 68 mm. Then the alloy powder was sintered at 1100° C. for 30 min. under vacuum condition.

Figure 3:
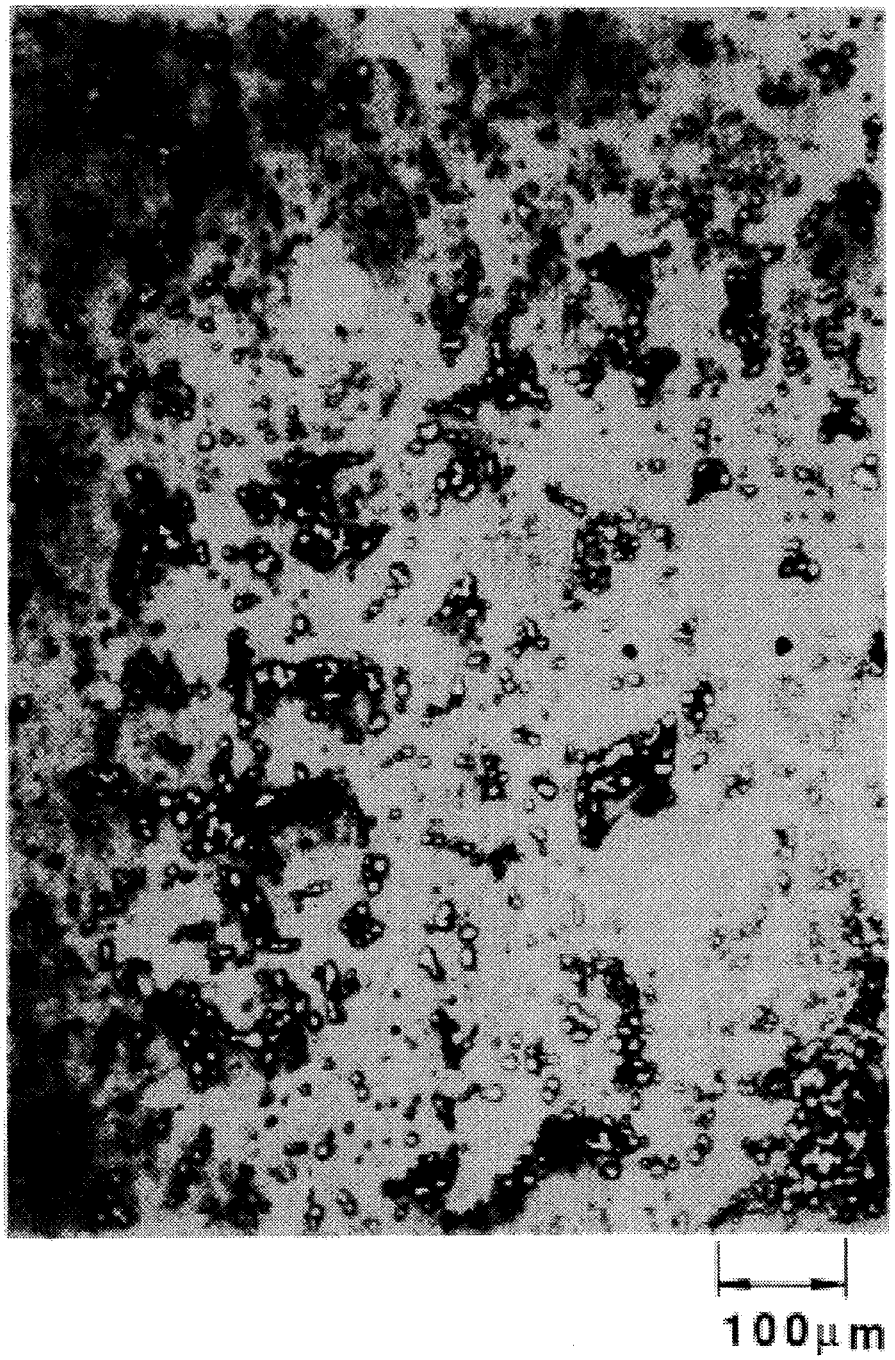
FIG. 3 is a microphotograph showing the metallic structure of an electrical contact material formed of Cu-10 wt %Cr according to the present invention.

The obtained Cu-20 wt %Cr article shows homogeneous Cr distribution as shown in FIG. 3, with a mean Cr particle size of 10 μm.

Cu-10 wt %Cr atomized powder and Cu-5 wt %Cr atomized powder were sintered similarly as the aforementioned, then articles having 55 mm of diameter were formed. Cr distribution in both articles are homogeneous. Distribution width of Cr could be narrowed, and mean Cr particle size is 10 μm.

EXAMPLE 3

Cu-20 wt %Cr atomized powder, having less than 150 μm of particle size, was canned in a metal housing having 62 mm of inner diameter. Then the alloy powder was compacted by hot isostatic pressing (HIP) at 1000° C. for 1 hour under the pressure of about 2000 kgf/cm$^2$ using argon gas. After compacting, the alloy was sintered. The obtained article had a 55 mm diameter. Mean particle diameter of Cr in the article is in the range of 2 to 5 μm. Particle diameter was not significantly enlarged compared to the alloyed powder.

Cu-10 wt %Cr atomized powder and Cu-5 wt %Cr atomized powder were compacted and sintered similarly to the aforementioned to form articles, respectively. Cr distribution in the both of articles can be also narrowed, and homogeneous Cu—Cr composition is established in both.

Thus, an electrical contact material having homogeneous distribution of fine Cr particles of which mean particle diameter is less than 10 μm can be obtained by the methods of both of EXAMPLES 2 and 3.

FIGS. 4 to 8 indicate characteristics comparisons of the electrical contact material of the present invention against that of conventionally utilized material.

Figure 4:
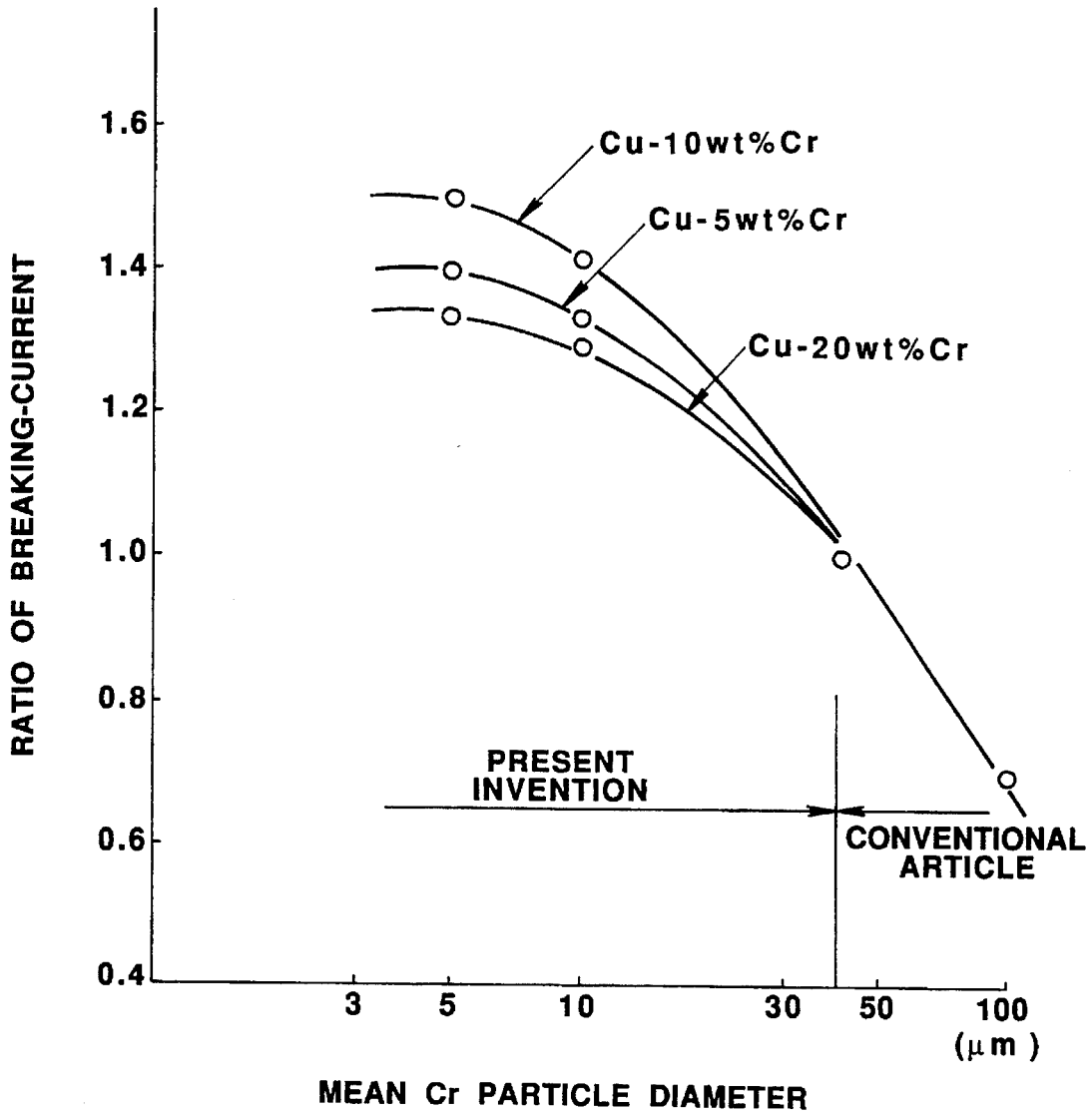
FIG. 4 is a graph showing a relationship between mean Cr particle diameter and a breaking-current of the alloys.

Referring now to FIG. 4, which shows a relationship between mean particle diameter of Cr and breaking current of Cu-5 wt %Cr, Cu-10 wt %Cr, and Cu-20 wt %Cr, the breaking ability of an article can be raised corresponding minimization of Cr diameter. This is caused by homogeneous distribution of Cr particles allowing an arc generated by a current to be dispersed smoothly. From the results shown in FIG. 4, 5 to 20 wt % of Cr with less than or equal to 20 μm particle diameter is preferable.

Figure 5:
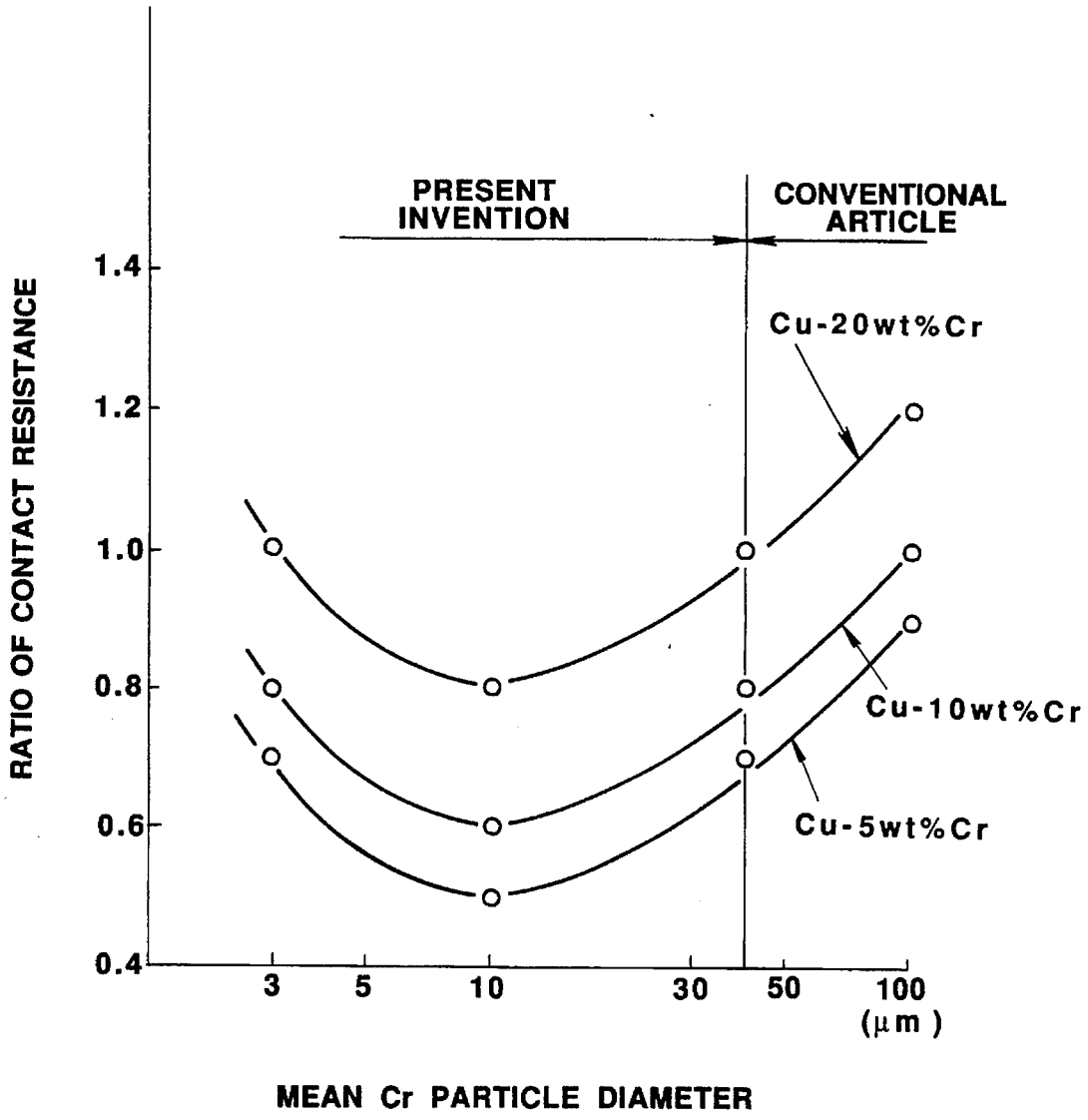
FIG. 5 is a graph showing a relationship between mean Cr particle diameter and contact resistance of the alloys.

Referring now to FIG. 5, which shows a relationship between mean Cr particle diameter and contact resistance against the same articles of FIG. 4, contact resistance can be reduced according to minimization of Cr diameter. However, when Cr particle diameter is less than 10 μm, hardness of the article is raised. Therefore, contact resistance tends to be increased at less than 10 μm of Cr particle diameter.

Figure 6:
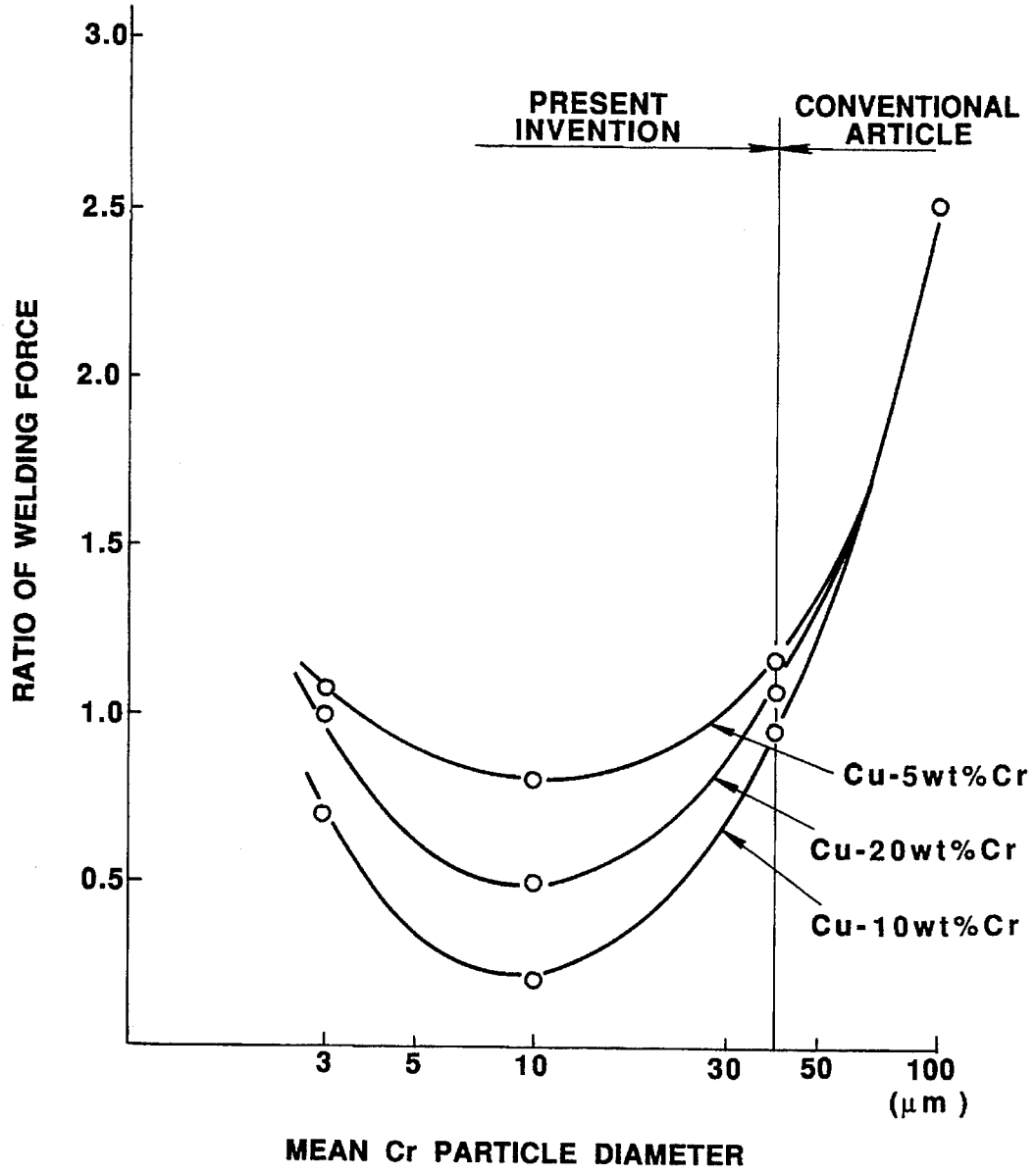
FIG. 6 is a graph showing a relationship between mean Cr particle diameter and welding force of the alloys.

FIG. 6 shows a relationship between mean Cr particle diameter and welding force. Welding force is the force necessary for separating materials after supplying desired amount of current for desired duration under pressure of 50 kgf (about 490N). From the results shown in FIG. 6, welding force can be also reduced according to minimization of Cr diameter, as a result of reduction of the contact resistance. However, when Cr particle diameter is less than 10 μm, the contact resistance is increased as shown in FIG. 5, therefore, welding force can be also increased.

Figure 7:
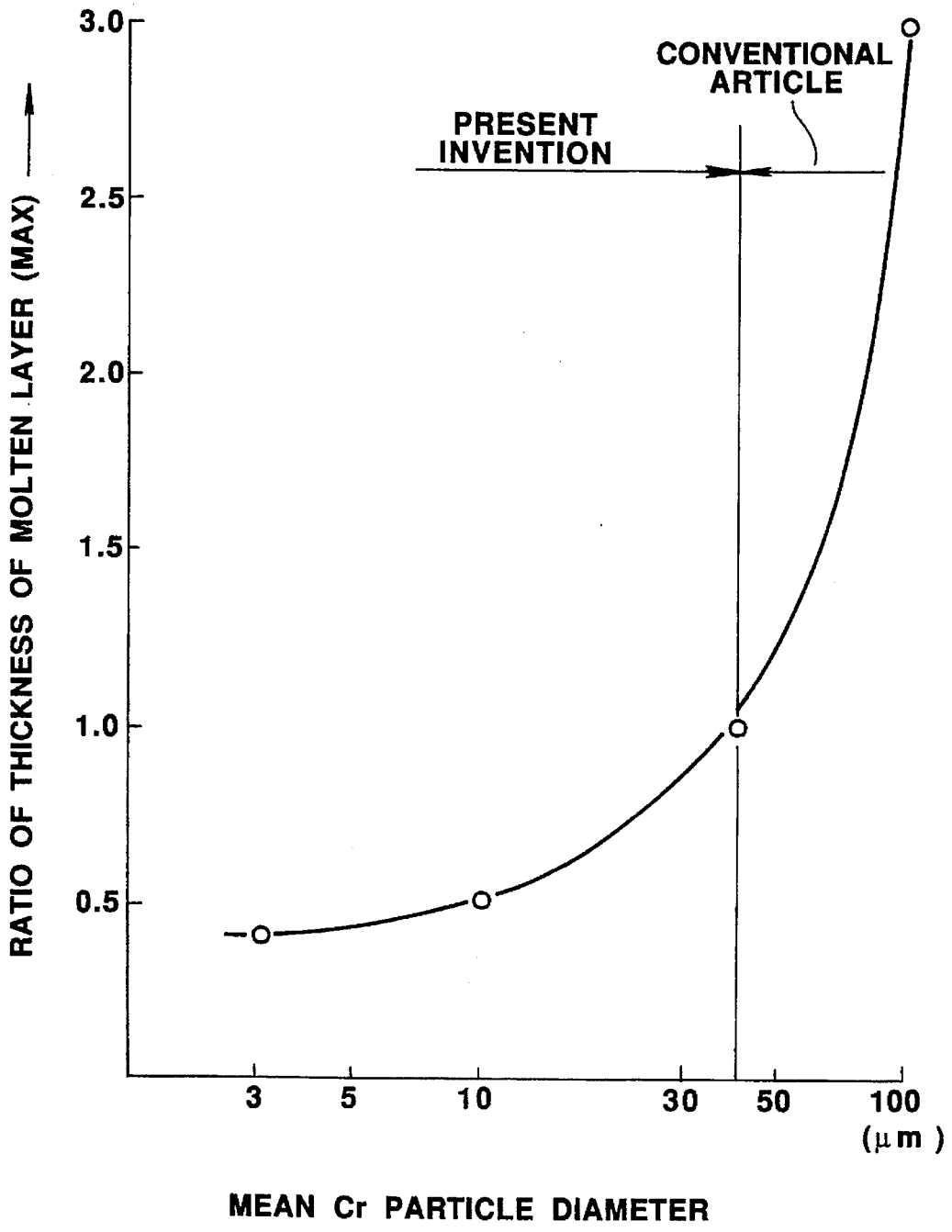
FIG. 7 is a graph showing a relationship between mean Cr particle diameter and a thickness of a molten layer.
Figure 8:
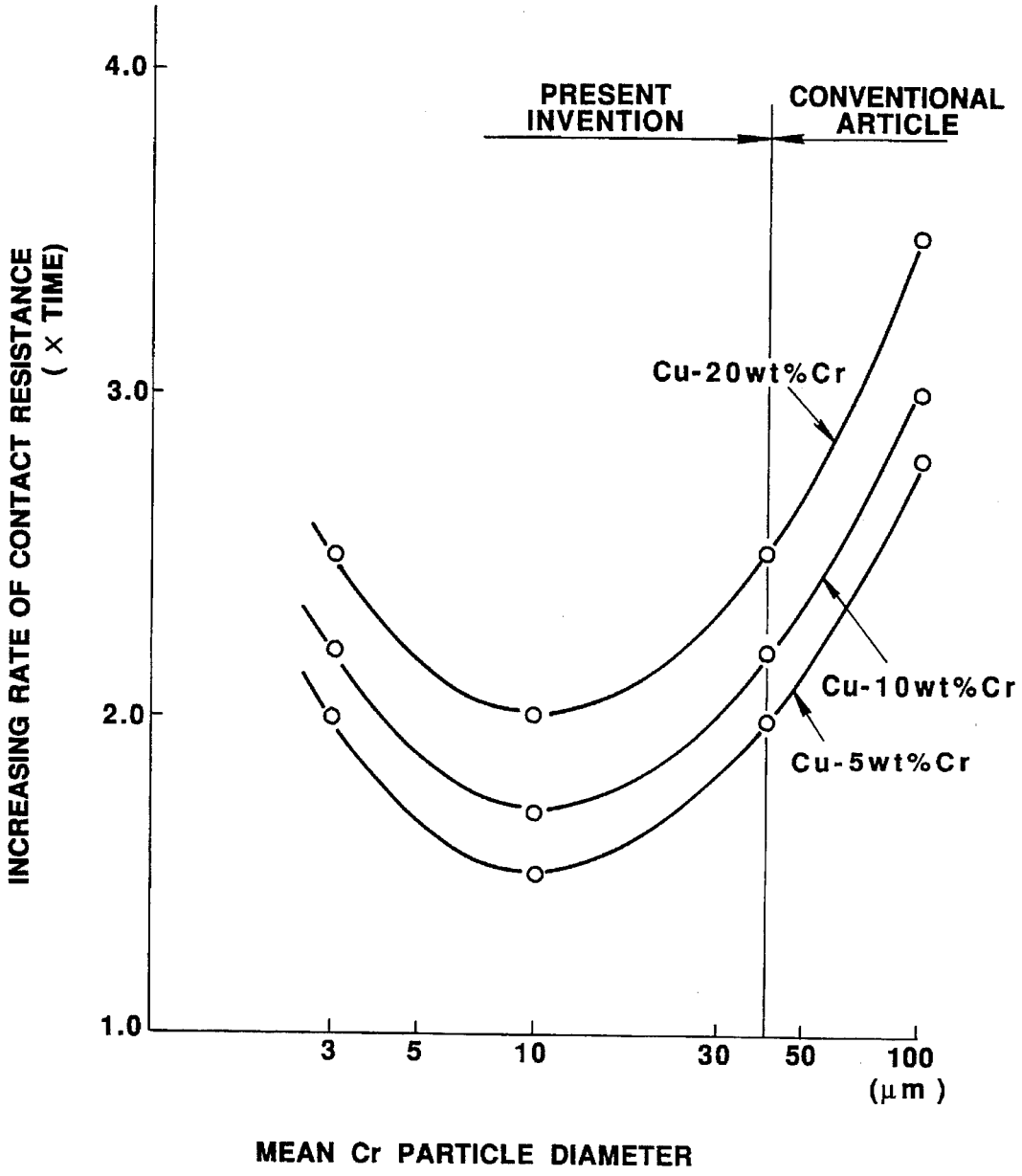
FIG. 8 is a graph showing a relationship between mean Cr particle diameter and an increase rate of contact resistance after current breaking.

FIG. 7 shows a relationship between mean Cr particle diameter and maximum thickness of the molten layer of the article surface after current breaking. When large mount of current is broke, the surface of the article is partially melted by the arc generated in the process of charging. The molten layer is rapidly cooled after arc annihilation, thus fine dispersion layer of Cu—Cr having rich Cr is formed on the article surface. The dispersion layer indicates good voltage withstandance, but has high resistance. Therefore, contact resistance is raised after large-current breaking, accordingly, it is preferred that the molten layer is formed thin, widely spread, and uniformly. From the results shown in FIG. 7, the molten layer can be homogenized and thinned according to minimization of Cr diameter.

Thus, increasing rate of contact resistance after current breaking can be reduced by minimization of Cr diameter. However, when Cr diameter becomes less than 10 μm, hardness of the article increases, therefore, contact resistance is increased.

Accordingly, Cr having a mean particle diameter of 2 to 20 μm which is uniformly dispersed in a Cu matrix is the most preferred composition of material for an electrical contact point. In order to obtain this composition, mean particle diameter of less than or equal to 5 μm of Cr must be selected for sintering after atomization of Cu—Cr.

According to the present invention, 2 to 20 μm of mean Cr particle diameter can be obtained because Cr particles in the alloyed powder are disintegrated to less than or equal to 5 μm by atomizing the alloy mixture. Therefore, Cr in the obtained article can be dispersed uniformly, so breaking-current can be raised and contact resistance can be reduced, compared to electrical contact material formed by conventional powder metallurgy. Thus, the article obtained according to the method of the present invention shows excellent characteristics as electrical contact material.

While the present invention has been disclosed in terms of the preferred embodiment in order to facilitate better understanding of the invention, it should be appreciated that the invention can be embodied in various ways without depending from the principle of the invention. Therefore, the invention should be understood to include all possible embodiments and modification to the shown embodiments which can be embodied without departing from the principle of the inventions as set forth in the appended claims.

What is claimed is:

1. A method for forming an electrical contact material comprising the steps of:

preparing a mixture of copper and chromium, deoxidizing said mixture by melting said mixture into a molten alloy in atmosphere of inert gas to reduce an oxygen content in said mixture to a level of less than 1000 ppm, atomizing said molten alloy to obtain an alloy powder, said atomizing step allowing a mean powder diameter of chromium to be less than or equal to 5 μm and being homogeneously dispersed in said alloy powder, and sintering said alloy powder to form a sintered matrix of copper including chromium particles being fined after sintering to a level of 2 to 20 μm, while maintaining homogeneous dispersion thereof in said sintered matrix to form said electrical contact material.

2. A method as set forth in claim 1, wherein said inert gas is selected from the group consisting of argon and nitrogen.

3. A method as set forth in claim 1, wherein said atomizing is accomplished by gas atomization.

4. A method as set forth in claim 3, wherein said gas is inert gas selected form the group consisting of argon and nitrogen.

5. A method as set forth in claim 1, wherein said atomizing is accomplished by water atomization.

6. A method as set forth in claim 1, wherein a mean particle diameter of said alloy powder is less than or equal to 150 μm.

7. A method for forming an electrical contact material comprising the steps of:

preparing a mixture of copper and chromium, deoxidizing said mixture by melting said mixture into a molten alloy in a vacuum to reduce an oxygen content in said mixture to a level of less than 1000 ppm, atomizing said molten alloy to obtain an alloy powder, said atomizing step allowing a mean powder diameter of chromium to be less than or equal to 5 μm and being homogeneously dispersed in said alloy powder, and sintering said alloy powder to form a sintered matrix of copper including chromium particles being fined after sintering to a level of 2 to 20 μm, while maintaining homogeneous dispersion thereof in said sintered matrix to form said electrical contact material.

* * * * *